US008512925B2

(12) United States Patent
Moribe et al.

(10) Patent No.: US 8,512,925 B2
(45) Date of Patent: Aug. 20, 2013

(54) MAGNETIC TONER

(75) Inventors: Shuhei Moribe, Mishima (JP); Katsuhisa Yamazaki, Numazu (JP); Toru Takahashi, Mishima (JP); Daisuke Tsujimoto, Suntou-gun (JP); Masami Fujimoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 13/354,078

(22) Filed: Jan. 19, 2012

(65) Prior Publication Data

US 2012/0196219 A1 Aug. 2, 2012

(30) Foreign Application Priority Data

Jan. 27, 2011 (JP) ..... 2011-015266

(51) Int. Cl.
*G03G 9/08* (2006.01)

(52) U.S. Cl.
USPC ..... 430/106.1; 430/106.2; 430/109.4; 430/111.41

(58) Field of Classification Search
USPC ..... 430/106.1, 106.2, 109.4, 111.41
See application file for complete search history.

(56) References Cited

U.S. PATENT DOCUMENTS

| | | | |
|---|---|---|---|
| 5,354,637 | A | 10/1994 | Shimamura et al. |
| 5,406,357 | A | 4/1995 | Nakahara et al. |
| 5,415,967 | A | 5/1995 | Sakashita et al. |
| 5,436,701 | A | 7/1995 | Shimojo et al. |
| 5,447,813 | A | 9/1995 | Hagiwara et al. |
| 5,547,796 | A | 8/1996 | Kohtaki et al. |
| 5,716,746 | A | 2/1998 | Mikuriya et al. |
| 5,968,701 | A | 10/1999 | Onuma et al. |
| 6,020,102 | A | 2/2000 | Fujimoto et al. |
| 6,077,638 | A | 6/2000 | Tanikawa et al. |
| 6,120,961 | A | 9/2000 | Tanikawa et al. |
| 6,156,471 | A | 12/2000 | Kobori et al. |
| 6,187,496 | B1 | 2/2001 | Tanikawa et al. |
| 6,203,959 | B1 | 3/2001 | Tanikawa et al. |
| 6,235,441 | B1 | 5/2001 | Tanikawa et al. |
| 6,426,169 | B1 | 7/2002 | Onuma et al. |
| 6,458,499 | B1 | 10/2002 | Onuma et al. |
| 6,541,174 | B1 | 4/2003 | Tanikawa et al. |
| 6,586,151 | B1 | 7/2003 | Naka et al. |
| 6,589,701 | B2 | 7/2003 | Yamazaki et al. |
| 6,653,036 | B1 | 11/2003 | Tanikawa et al. |
| 6,670,087 | B2 | 12/2003 | Fujikawa et al. |
| 6,703,176 | B2 | 3/2004 | Naka et al. |

(Continued)

FOREIGN PATENT DOCUMENTS

| | | | |
|---|---|---|---|
| JP | 2003-280254 | A | 10/2003 |
| JP | 2005-265958 | A | 9/2005 |

OTHER PUBLICATIONS

Takahashi, et al., U.S. Appl. No. 13/354,092, filed Jan. 19, 2012.

*Primary Examiner* — Mark A Chapman
(74) *Attorney, Agent, or Firm* — Fitzpatrick, Cella, Harper & Scinto

(57) ABSTRACT

Provided is a magnetic toner capable of preventing electrostatic offset while attaining a high image quality by a high speed machine. The magnetic toner comprises magnetic toner particles, each of which contains a binder resin and a magnetic material, and a fine inorganic powder, in which the binder resin contains a polyester unit, and the magnetic toner has a dielectric loss factor at 40° C. and 100 kHz of 0.40 pF/m or more but 1.00 pF/m or less and a dielectric loss factor at 150° C. and 100 kHz of 0.50 pF/m or more but 4.00 pF/m or less.

3 Claims, 1 Drawing Sheet

U.S. PATENT DOCUMENTS 6,875,549 B2 4/2005 Yamazaki et al.
6,881,527 B2 4/2005 Moribe et al.
7,001,703 B2 2/2006 Moribe et al.
7,097,951 B2 8/2006 Moribe et al.
7,147,981 B2 12/2006 Fujikawa et al.
7,150,953 B2 12/2006 Yamazaki et al.
7,267,919 B2 9/2007 Moribe et al.
7,273,686 B2 9/2007 Onuma et al.
7,288,354 B2 10/2007 Moribe et al.
7,351,509 B2 4/2008 Moribe et al.
7,422,832 B2 9/2008 Ogawa et al.
7,537,877 B2 5/2009 Yoshiba et al.
7,544,455 B2 6/2009 Yoshiba et al.
7,638,251 B2 12/2009 Yamazaki et al.
7,700,254 B2 4/2010 Moribe et al.
7,740,998 B2 6/2010 Yamazaki et al.
7,855,042 B2 12/2010 Kobori et al.
7,897,316 B2 3/2011 Yamazaki et al.
8,026,030 B2 9/2011 Moribe et al.
8,057,977 B2 11/2011 Moribe et al.
2011/0256480 A1 10/2011 Yamazaki et al.

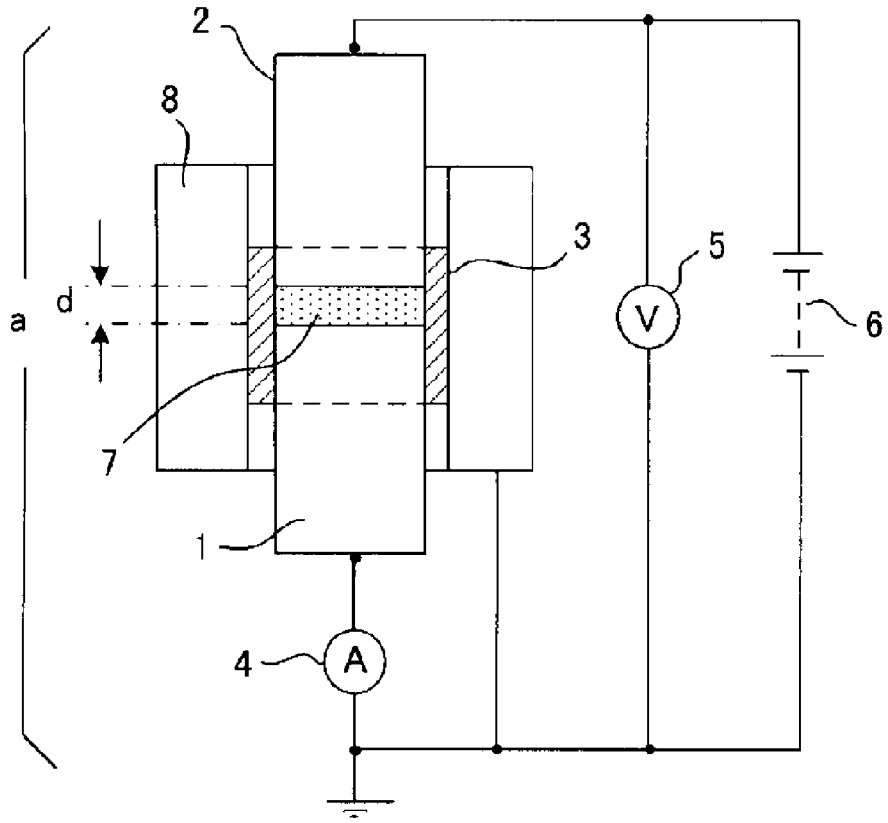
2
8
3
5
V
6
a
d
7
1
4
A

MAGNETIC TONER

BACKGROUND OF THE INVENTION

1. Field of the Invention

The present invention relates to a magnetic toner for use in electrophotography, an image forming method for visualizing an electrostatic latent image and toner jet.

2. Description of the Related Art

In a general electrophotographic method known in the art, an electrical latent image is formed on an image carrier (photoreceptor) by various units using a photoconductive substance; and subsequently, toner is supplied to the latent image to visualize it as a toner image. The toner image is, if necessary, transferred onto a transfer material such as a paper sheet and then fixed the toner image onto the transfer material by application of heat/pressure to obtain a transcript.

As a fixing apparatus used in the fixing step, conventionally various types of fixing apparatuses have been developed. In view of reducing wait time and power-saving, an on-demand system fixing apparatus using a ceramic heater small in heat capacity in combination with a film has been put into practical use.

However, in the on-demand system, an electric field is likely to be generated by frictional electrification between a transfer material, a fixing film and a fixing member such as a fixing roller to attract toner placed on the transfer material to the fixing member. As a result, a part of the toner particles is transferred onto the fixing member and disturbs or smudges the toner image on the transfer material. This is called an electrostatic offset phenomenon. Particularly with an increase of printing speed in recent years, frictional electrification of the fixing member tends to be accelerated. With the tendency, a countermeasure against electrostatic offset induced by a high-speed operation must be urgently taken.

As a countermeasure against the electrostatic offset, forcibly generating an electric field by which electrostatic offset between fixing members is prevented has been proposed. However, an electric field forcibly generated induces local generation of a high electric field on the surface of the fixing member and causes discharge, with the result that a damage such as a pin hole is given to the surface of the fixing member. Furthermore, since a unit for generating an electric field is provided to a fixing apparatus, the structure of a main body is complicated or the fixing apparatus is enlarged. This structural arrangement results in being against miniaturization of a main body in view of save-energy and save-space desired in recent years.

In the circumstances, as a countermeasure against electrostatic offset, many proposals directed to not the main body but toner have been made.

For example, Japanese Patent Application Laid-Open No. 2003-280254 proposes an approach for preventing electrostatic offset by adding a plurality of fine inorganic powders different in resistance to a toner particle and defining the liberation rates of the fine inorganic powders to reduce toner electrification characteristics. However, electrostatic offset can be suppressed to some extent by this method; however, part of liberated fine inorganic powder is often scattered on a transfer material and causes an image defect such as white omission of an image (specifically occurs in a high-speed machine). In addition, if the toner reduced in electrification characteristics in this manner is fixed, since electrostatic adhesion between a transfer material and the toner is low, the toner partly remains on a fixing member without removing from the fixing member. As a result, an image omission occurs, causing image irregularity.

In the circumstances, Japanese Patent Application Laid-Open No. 2005-265958 proposes a solution to these problems by improving not additives but a main substance, i.e., a magnetic toner particle. In this proposal, electrostatic offset is prevented by defining the dielectric constant at 40° C. and a frequency dependence of a dielectric tangent (tan δ). However, the approach may not be sufficient in a recent high-speed fixing apparatus. Furthermore, although the dielectric property at a temperature (40° C.) before a magnetic particle is fed to a fixing apparatus is discussed, dielectric property at a high temperature, i.e., at high-temperature operation during a fixing operation, is not discussed. Thus, in view of properties after thermofusion such as fixation property and mold-releasing property from the surface of a fixing member, a further improvement is required.

As described above, there are a great many technical problems for attaining high image quality free of scattering and image omission; at the same time, for preventing electrostatic offset at the time of high-speed development. A further improvement is required.

An object of the present invention is to provide a magnetic toner in which the aforementioned problems have been overcome. More specifically, the object of the present invention is to provide a magnetic toner providing a high-quality image free of scattering and image omission and capable of preventing an electrostatic offset in a high-speed development system.

SUMMARY OF THE INVENTION

The present invention is directed to a magnetic toner comprising magnetic toner particles, each of which contains a binder resin and a magnetic material, and a fine inorganic powder, in which the binder resin contains a polyester unit and the magnetic toner has i) a dielectric loss factor at 40° C. and 100 kHz of 0.40 pF/m or more but 1.00 pF/m or less, and ii) a dielectric loss factor at 150° C. and 100 kHz of 0.50 pF/m or more but 4.00 pF/m or less.

According to the present invention, electrostatic offset can be prevented by controlling a dielectric loss factor within a predetermined temperature range while attaining a high image quality by a high speed machine, without forcibly generating an electric field in a fixing apparatus.

Further features of the present invention will become apparent from the following description of exemplary embodiments with reference to the attached drawing.

BRIEF DESCRIPTION OF THE DRAWINGS

FIGURE is an explanatory view illustrating an apparatus for use in measuring volume resistivity of fine inorganic powder C.

DESCRIPTION OF THE EMBODIMENTS

The present inventors have conducted studies on electrostatic offset and adhesiveness of a magnetic toner onto a transfer material at the time of fixation. As a result, the present inventors could successfully find that the factors controlling these phenomena are the same and that electrostatic offset can be prevented by controlling this factor; simultaneously with improvement of the adhesiveness of a magnetic toner onto a transfer material.

At the time of fixation, frictional electrification occurs between a transfer material and a fixing member or between fixing members, with the result that an electric field is generated and thereby a magnetic toner on the transfer material is attracted to the fixing member. As a result, a part of the magnetic toner particles is transferred to the fixing member and disturbs or smudges a toner image formed on the transfer paper. This is a problem called an electrostatic offset phenomenon.

Accordingly, at the stage before fixation, it is important to design a magnetic toner having a low response to such an electric field.

At the fixing nip portion at which a magnetic toner and a fixing film are in contact with each other, the electrostatic attraction force is relaxed at a time. However, in another view point of adhesiveness to a transfer material, in turn, the magnetic toner is required to have a good electric field responsive to a polar group present in a transfer material (paper).

Conventionally, in view of fixation, the thermofusion property of a magnetic toner is an important. Various studies have been made from this standpoint. However, the present inventors found that, to obtain a high-quality image exclusively free of image omission, not only thermofusion property of a magnetic toner but also electric-field response to a transfer material is an important factor.

The electric-field response is an indicator of polarization performance in response to the force applied by an electric field. Thus, a magnetic toner having a good electric-field response is immediately polarized in response to a polar group of a transfer material at the time of thermofusion and enhances affinity with the transfer material. Furthermore, polarization immediately occurs between magnetic toner particles, improving adhesiveness of magnetic toner particles to each other.

Accordingly, at the time of thermofusion, separately from an adhesion factor due to thermofusion between a transfer material and a magnetic toner, another adhesion factor due to polarization works, with the result that the magnetic toner can be uniformly and tightly fixed onto the transfer material without partial removal of the magnetic toner and attachment thereof on a fixing member.

Particularly, in a high speed machine, since contact time between a fixing member and a magnetic toner is extremely short at the fixation nip portion, how soon the magnetic toner is polarized in response to the electric field is a key point to improve adhesiveness to a transfer material.

As described above, to prevent electrostatic offset and to improve adhesiveness to a transfer material, it is required for the magnetic toner to have low response to an electric field before thermofusion, but required to have a high response to the electric field at the time of the thermofusion. In short, before and after the thermofusion, a desired behavior of the magnetic toner to the electric field varies.

Accordingly, the magnetic toner of the present invention is characterized in that response to an electric field is controlled to be lower at normal temperature and to be higher at a high temperature than a conventional magnetic toner having a polyester unit as a binder resin.

The present inventors have conducted studies focusing on the electric-field response to a magnetic toner before and after fixation. As a result, the present inventors solved the above problem by controlling dielectric loss factors (∈") respectively at 40° C. and 150° C. at 100 kHz.

The present inventors focused on 100 kHz. This is because 100 kHz is a favorable frequency to check polarization performance at a particle level. Furthermore, the present inventors specified that the dielectric loss factor of the normal temperature side is measured at a temperature of 40° C. This is because the temperature of the machine before a transfer material is loaded into a fixing apparatus is about 40° C. Furthermore, the temperature of the dielectric loss factor at the high temperature side is set at 150° C. This is because the temperature for completely melting the toner is about 150° C.

The dielectric loss factor (∈") is generally a value representing polarization response to an electric field. A high dielectric loss factor means that the polarization response to an electric field is low. In contrast, a low dielectric loss factor means that polarization response to an electric field is satisfactory.

The magnetic toner of the present invention is characterized in that the dielectric loss factor (∈") at 40° C. and 100 kHz is 0.40 pF/m or more but 1.00 pF/m or less, favorably 0.43 pF/m or more but 0.80 pF/m or less, and more favorably 0.45 pF/m or more but 0.60 pF/m or less. Accordingly, by designing the dielectric loss factor (∈") at 40° C. as mentioned above, the response of polarization to an electric field at normal temperature can be lowered than that of conventional one. As a result, it is difficult for a magnetic particle to follow electrostatic attraction force. Consequently, electrostatic offset can be prevented.

If the dielectric loss factor is less than 0.40 pF/m, polarization response to an electric field increases and electrostatic offset becomes more significant. In contrast, if the dielectric loss factor is larger than 1.00 pF/m, polarization response to an electric field becomes excessively low, with the result that toner is likely to scatter in transferring a toner image to a transfer material such as a paper sheet.

Furthermore, the magnetic toner of the present invention is characterized in that the dielectric loss factor at 150° C. and 100 kHz is 0.50 pF/m or more but 4.00 pF/m or less, favorably 0.60 pF/m or more but 2.50 pF/m or less, and more favorably 0.70 pF/m or more but 2.00 pF/m or less. Accordingly, by designing the dielectric loss factor (∈") at 150° C. as mentioned above, the response of polarization to an electric field at a high temperature can be improved.

As a result, adhesiveness to a transfer material is improved also at a high-speed machine and a high-quality image can be obtained without image omission.

If the dielectric loss factor at 150° C. and 100 kHz is less than 0.50 pF/m, adhesiveness to a transfer material decreases. As a result, the detachability of part of toner particles to a fixing member decreases, causing an image defect such as image omission. In contrast, if the dielectric loss factor is larger than 4.00 pF/m, adhesiveness of a magnetic toner to paper becomes extremely strong, with the result that damage such as collapse of a printed letter is likely to occur at the time of fixation.

The dielectric constant of a magnetic toner according to the present invention is measured by the following method.

A 4284A precision LCR meter (manufactured by Hewlett-Packard Development Company, L.P.) is corrected at frequencies of 1 kHz and 1 MHz, and a complex dielectric constant is measured at a frequency of 100 kHz. From the complex dielectric constant values measured, a dielectric loss factor ∈" is computationally obtained. A magnetic toner (1.0 g) is weighed and molded into a disk-form measurement sample having a diameter of 25 mm and a thickness of 1 mm or less (favorably 0.5 mm or more and 0.9 mm or less) by applying a load of 19600 kPa (200 kg/cm$^2$) over one minute. The measurement sample is loaded on ARES (manufactured by Rheometric Scientific F. E.) equipped with a dielectric constant measurement tool (electrode) having a diameter of 25 mm and fixed at a temperature of 40° C. Thereafter, the measurement sample is cooled to a temperature of 30° C., and heated to 150° C. at a temperature raising rate of 2° C. per minute and measured at a constant frequency of 100 kHz, while applying a load of 0.49 (50 g). During the measurement, a measurement value is taken every 15 seconds.

As mentioned in the foregoing, by controlling a dielectric loss factor in a predetermined temperature range, an electrostatic offset can be prevented while obtaining a high-quality image having neither scattering nor image omission, etc., by a high-speed machine without forcibly generating an electric field in a fixing apparatus.

Furthermore, the magnetic toner of the present invention favorably has a difference in Heat Flow (W/g) between temperatures 40° C. and 60° C. of 0.040 W/g or more in a DSC curve measured by a differential scanning calorimeter.

This temperature region corresponds to a glass transition temperature region of a magnetic toner, more specifically, a temperature region in which a magnetic toner starts molecular motion, and further a temperature region in which the toner is started to be heated immediately after the toner is loaded into a fixing apparatus. Therefore, if toner immediately starts molecular motion in this stage, a dielectric loss factor at 150° C. is easily controlled to a desired value, improving image quality.

Furthermore, the magnetic toner of the present invention favorably has a softening point (Tm) of a magnetic toner within the range of 110° C. or more but 160° C. or less to obtain a desired fixability by thermofusion.

Furthermore, in view of fixability, the peak molecular weight (Mp) measured by gel permeation chromatography (GPC) of a THF soluble matter preferably falls within the range of 3000 or more but 10000 or less.

Furthermore, in view of preventing high temperature offset, the THF insoluble matter in a magnetic toner is favorably 5 mass % or more but 40 mass % or less, and more favorably 7 mass % or more but 25 mass % or less.

As a factor having an effect on the dielectric loss factor of the present invention, the presence of a component having an effect on an electric field such as polarization of a magnetic toner can be considered. In particular, the magnetic toner of the present invention is characterized in that a binder resin contains a polyester unit.

The polyester unit has a large number of functional groups such as a carboxyl group and an ester group within a molecule having an effect on polarization. Accordingly, in view of imparting appropriate polarization performance to a magnetic toner in accordance with a temperature change, it is necessary to use a polyester unit.

Furthermore, as the binder resin to be used in the present invention, a polyester resin having molecules partly oriented is favorable. Of them, a linear polyester is particularly favorable.

By the presence of part of molecules oriented, before thermofusion, the molecules around the oriented molecule are hardly moved due to the intensive interaction called orientation. Accordingly, even if a large number of functional groups such as an ester group are present in a polyester molecule, the response of a magnetic toner to an electric field can be designed to be low. In contrast, at not less than a temperature at which the orientation collapses, these functional groups can move freely, and thus, the response of a magnetic toner to an electric field can be increased.

In the present invention, the components of a linear polyester resin particularly favorably used are as follows.

Examples of a divalent acid component include the following dicarboxylic acids or derivatives thereof: benzene dicarboxylic acids such as phthalic acid, terephthalic acid, isophthalic acid and phthalic anhydride, an anhydride or a lower alkyl ester thereof; alkyl dicarboxylic acids such as succinic acid, adipic acid, sebacic acid and azelaic acid, an anhydride or a lower alkyl ester thereof; alkenyl succinic acids or alkyl succinic acids such as n-dodecenyl succinic acid, and n-dodecyl succinic acid, an anhydride or a lower alkyl ester thereof; and unsaturated dicarboxylic acids such as fumaric acid, maleic acid, citraconic acid and itaconic acid, an anhydride or a lower alkyl ester thereof.

In the present invention, it is favorable that a part of a molecular chain of a binder resin is oriented, as mentioned above. Thus, an aromatic dicarboxylic acid is favorably used since it has a rigid planar structure and molecules easily oriented by π-π interaction due to the presence of many electrons delocalized due to the π electron system.

Particularly favorably, terephthalic acid and isophthalic acid are used since these compounds each easily form a linear structure. The content of such an aromatic dicarboxylic acid is favorably 50.0 mol % or more, and more favorably 70.0 mol % or more based on 100.0 mol % of the acid component constituting a polyester resin.

Examples of a divalent alcohol component include the followings: ethylene glycol, polyethylene glycol, 1,2-propanediol, 1,3-propanediol, propylene glycol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexane dimethanol (CHDM), hydrogenated bisphenol A, a bisphenol represented by Formula (1) and a derivative thereof:

(1)

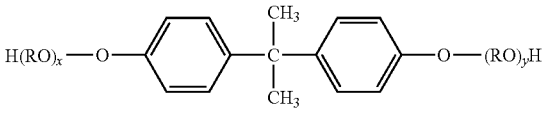

where R is an ethylene group or a propylene group; x and y each represent an integer of 0 or more; and, an average value of x+y is 0 to 10), and a diol represented by Formula (2).

(2)

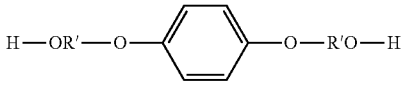

wherein R' represents —$CH_2CH_2$—, —$CH_2$—$CH(CH_3)$—, or —$CH_2$—$C(CH_3)_2$—.

Of them, a linear aliphatic alcohol having 2 to 6 carbon atoms is favorable in consideration that it is likely to have a linear structure in view of partly orienting molecules, and furthermore in view of increasing the number of ester groups per unit molecule in order to improve response to an electric field.

However, if a linear aliphatic alcohol is used alone, the degree of orientation is excessively high. Accordingly, the degree of the orientation of a polyester resin formed of an acid as mentioned above in combination with an alcohol as mentioned above must be disturbed. To disturb the degree of the orientation, a compound having a linear structure and a substituent at a side chain, by which the degree of orientation can be disturbed, such as neopentyl glycol, 2-methyl-1,3-propanediol and 2-ethyl-1,3-hexanediol, is particularly favorably used. Each of these alcohol components is favorably contained in an amount of 20 to 50% by mole, and further favorably 25 to 40% by mole based on the total alcohol component.

The polyester resin used in the present invention may contain, other than a divalent carboxylic acid compound and divalent alcohol compound as mentioned above, a monovalent carboxylic acid compound, a monovalent alcohol compound, a trivalent or more carboxylic acid compound and a trivalent or more alcohol compound, as a structural component.

Examples of the monovalent carboxylic acid compound include aromatic carboxylic acids having 30 or less carbon atoms such as benzoic acid and p-methyl benzoic acid; and aliphatic carboxylic acids having 30 or less carbon atoms such as stearic acid and behenic acid.

Furthermore, examples of the monovalent alcohol compound include aromatic alcohols having 30 or less carbon atoms such as benzyl alcohol; and aliphatic alcohols having or less carbon atoms such as lauryl alcohol, cetyl alcohol, stearyl alcohol and behenyl alcohol.

Examples of the trivalent or more carboxylic acid compound include, but not particularly limited to, trimellitic acid, trimellitic anhydride and pyromellitic acid.

Furthermore, examples of the trivalent or more alcohol compounds include trimethylolpropane, pentaerythritol and glycerin.

The method for producing a polyester resin of the present invention is not particularly limited and a known method can be used. For example, a polyester resin is produced by supplying a carboxylic acid compound and an alcohol compound as mentioned above together, and polymerizing the carboxylic acid compound and the alcohol compound through an esterification reaction or a transesterification reaction and a condensation reaction. In a polymerization process for producing a polyester resin, for example, a polymerization catalyst such as titanium tetrabutoxide, dibutyl tin oxide, tin acetate, zinc acetate, tin sulfide, antimony trioxide and germanium dioxide can be used. Furthermore, the polymerization temperature is not particularly limited; however, the polymerization temperature favorably falls within the range of 180° C. or more but 290° C. or less.

Furthermore, the binder resin may be a hybrid resin prepared by chemically binding a polyester unit and a vinyl copolymer unit.

The mixing ratio of the polyester unit and the vinyl copolymer unit is favorably 50:50 to 100:0 by mass ratio. If the mixing ratio of the polyester unit is less than 50 mass %, the number of functional groups such as an ester group decreases. As a result, electric-field response reduces.

As a vinyl monomer for producing a vinyl copolymer unit to be used in the binder resin of the present invention, the following styrene monomer and acrylic acid monomer are mentioned.

Examples of the styrene monomer as a monomer for producing a vinyl copolymer unit include styrene and o-methylstyrene. Examples of the acrylic acid monomer as a monomer for producing a vinyl copolymer unit include acrylic acid, methyl acrylate and n-butyl acrylate.

The vinyl copolymer unit may be a resin produced by using a polymerization initiator. As the polymerization initiator, a known initiator as mentioned below is used. Examples of the polymerization initiator include 2,2'-azobisisobutyronitrile, 2,2'-azobis(4-methoxy-2,4-dimethylvaleronitrile) and 2,2'-azobis(2,4-dimethylvaleronitrile).

These initiators are each favorably used in an amount of 0.1 part by mass or more but 10.0 parts by mass or less based on a monomer (100.0 parts by mass), in view of efficiency.

The hybrid resin is a resin in which a polyester unit and a vinyl copolymer unit are chemically bound directly or indirectly.

Thus, polymerization is performed by using a compound capable of reacting with both monomers of the resin (hereinafter referred to as a "double reactive compound"). Examples of such a double reactive compound include compounds such as fumaric acid, acrylic acid, methacrylic acid, citraconic acid, maleic acid and dimethyl fumarate contained in a monomer of a condensation polymerized resin as mentioned above and a monomer of an addition polymerized resin as mentioned above. Of these, fumaric acid, acrylic acid and methacrylic acid are favorably used.

The use amount of the double reactive compound is 0.1 mass % or more but 20.0 mass % or less, and favorably 0.2 mass % or more but 10.0 mass % or less based on the total raw-material monomers.

The binder resin of the present invention favorably has an endothermic peak P derived from enthalpy relaxation at a temperature of 55° C. or more but 75° C. or less in a DSC curve, which is obtained by differential scanning calorimetry.

Enthalpy relaxation is a phenomenon where volume (enthalpy) expands (is relaxed) during a phase-transition of a polymer from a glass-state into supercooled liquid state. This phenomenon is found when molecules move so as to cause orientation in phase transition time, and remarkably found in a resin whose molecular chain is easily oriented. Therefore, the presence or absence of a peak derived from enthalpy relaxation is influenced by the shape of a polymer chain of a binder resin. A binder resin having a linear polymer chain tends to have a peak.

Furthermore, the endothermic quantity $\Delta H$ of a main endothermic peak obtained in a DSC curve of a binder resin is preferably 0.30 J/g or more but 2.00 J/g or less, and more favorably 0.50 J/g or more but 1.50 J/g or less in obtaining desired fixability and electric-field response. Note that the endothermic peak having the largest endothermic quantity is regarded as a main endothermic peak.

Furthermore, in view of fixability, the softening point of a binder resin is preferably 70° C. or more but 150° C. or less, and more favorably 90° C. or more but 140° C. or less.

Furthermore, the binder resin favorably has the following molecular weight distribution, which is measured by gel permeation chromatography (GPC) of a tetrahydrofuran (THF) soluble matter The peak molecular weight Mp (R) of the binder resin is favorably 5,000 or more but 20,000 or less and the weight average molecular weight Mw (R) is favorably 8,000 or more but 100,000 or less.

As described later, a magnetic material as a dielectric substance is also a factor having an effect on a dielectric loss factor. In order to make the magnetic toner to be elastic in view of controlling dispersibility of the magnetic material, the THF insoluble component is 5.0 mass % or more but 50.0 mass % or less, and favorably 7.0 mass % or more but 30.0 mass % or less.

The THF insoluble matter of the binder resin refers to a THF insoluble matter obtained by Soxhlet extraction. The THF insoluble matter may be contained in a single binder resin or may be prepared by a crosslinking reaction when two types of resins different in softening point are mixed.

Furthermore, as a method for preparing a THF insoluble matter by mixing two types of resins different in softening point is a method of mixing two types of resins in a wet-process and crosslinking the resins is more favorable. This is because homogeneity of resins is improved and dispersibility of other materials becomes easily controlled by involving two types of binder resins in crosslinking in a wet-process.

The magnetic material to be used in the magnetic toner of the present invention is favorably a magnetic iron oxide as a dielectric substance. The dielectric loss factor of a magnetic toner is easily controlled to be a desired value by controlling the dispersibility of the magnetic toner in a resin of a magnetic iron oxide as a dielectric substance.

As the magnetic iron oxide, an iron oxide such as magnetite, maghemite and ferrite is used. Furthermore, the magnetic iron oxide is favorably subjected once to a disentangle treatment by shearing slurry at the time of manufacturing in order to control dispersibility of a magnetic iron oxide in a toner particle.

In the present invention, the content of a magnetic iron oxide in a magnetic toner is favorably 15.0 mass % or more but 55.0 mass % or less, and more favorably 20.0 mass % or more but 50.0 mass % in a magnetic toner. If the content falls within the range, a desired dielectric loss factor can be easily obtained.

As the magnetic properties of the magnetic iron oxide under application of 795.8 kA/m, it is favorable that coercive force Hc is 1.6 kA/m or more but 12.0 kA/m or less; and saturation magnetization σs is 50.0 $\mu m^2$/kg or more but 200.0 $\mu m^2$/kg or less (favorably 50.0 $\mu m^2$/kg or more but 100.0 $\mu m^2$/kg or less). Furthermore, it is favorable that the residual magnetization σr is 2.0 $\mu m^2$/kg or more but 20.0 $\mu m^2$/kg or less.

Furthermore, the magnetic iron oxides mentioned above each favorably have a number average particle diameter of 0.05 μm or more but 0.50 μm or less. Furthermore, the volume resistivity of a magnetic iron oxide is favorably $1.0\times10^3$ Ω·cm or more but $1.0\times10^7$ Ω·cm or less (more favorably, $5.0\times10^3$ Ω·cm or more but $5.0\times10^6$ Ω·cm or less) in view of preventing electrostatic offset.

The shape of the magnetic iron oxide particle is favorably an octahedron. This is because octahedron magnetic iron oxide particles are easily separated from each other, less aggregated and dispersibility thereof to a binder resin can be easily controlled.

In the present invention, to impart mold-releasing characteristics to a magnetic toner, if necessary, a mold-releasing agent (wax) can be used.

As the wax, in view of dispersibility thereof in a magnetic toner particle and efficient mold-releasing characteristics, a low molecular-weight polyethylene, a low molecular-weight polypropylene, microcrystalline wax, a hydrocarbon wax such as paraffin wax are favorably used. If necessary, a single or two types or more waxes may be used in combination in a small amount.

Specific examples of the wax include the following ones: Biscol (registered trade mark) 330-P, 550-P, 660-P, TS-200 (manufactured by Sanyo Chemical Industries, Ltd.); Hi-wax 400P, 200P, 100P, 410P, 420P, 320P, 220P, 210P, 110P (manufactured by Mitsui Chemicals Inc.); Sasol H1, H2, C80, C105, C77 (Schumann Sasol); HNP-1, HNP-3, HNP-9, HNP-10, HNP-11, HNP-12 (NIPPON SEIRO CO. LTD), Unilin (registered trade mark) 350, 425, 550, 700, and Unisid (registered trade mark) 350, 425, 550, 700 (Toyo Petrolite); and Japanese wax, bees wax, rice wax, Candelilla wax and carnauba wax (available from CERARICA NODA Co., Ltd.).

The timing of adding the wax may be during melt/kneading time in a production process for a magnetic toner or during a production process for a binder resin, and is appropriately selected from the addition manners according to conventional methods. Furthermore, these waxes may be used alone or in combination.

The wax is favorably added in an amount of 1.0 part by mass or more but 20.0 parts by mass or less based on a binder resin (100.0 parts by mass).

In the magnetic toner of the present invention, a charge-controlling agent can be used in order to stabilize electrification characteristics.

The content of the charge-controlling agent varies depending upon the type or physical properties of other constitutional materials for the magnetic toner particle; however, the content is generally, 0.1 part by mass or more but 10.0 parts by mass or less based on a binder resin (100.0 parts by mass) in the magnetic toner particle.

As such a charge-controlling agent, a charge-controlling agent for controlling a magnetic toner to be negatively charged and a charge-controlling agent for controlling a magnetic toner to be positively charged are known. The charge-controlling agents can be used alone or in combination with two or more types depending upon the type and usage of the magnetic toner. The magnetic toner of the present invention may be positively or negatively charged; however, since a favorable binder resin, i.e., a polyester resin, itself, has high negative electrification characteristics, it is favorable to use a negatively charged magnetic toner.

Examples of the charge-controlling agent for controlling a magnetic toner to be negatively charged include metal compounds such as an organic metal compound, a chelate compound, a monoazo metal compound and an acetyl acetone metal compound. Other examples thereof include aromatic oxycarboxylic acids, aromatic mono- and polycarboxylic acids and a metal salt, an anhydride and an ester thereof, phenol derivatives such as a bisphenol; and further a metal containing salicylic acid compound and a metal-containing naphthoic acid compound are mentioned.

Of them, to sufficiently exert the effect of the present invention, a salicylic metal compound is satisfactorily used, and particularly, the metal of the salicylic metal compound is favorably aluminum or zirconium. The most favorable charge-controlling agent is an aluminum salicylate compound.

The salicylic metal compound has an ester group in the ligand and play a role of assisting response to the electric field after a magnetic toner is melted, together with a polyester resin. Accordingly, the salicylic metal compound is favorable in view of excellent control of a dielectric loss factor at 150° C.

Specific Examples thereof that can be used include Spilon Black TRH, T-77, T-95, TN-105 (manufactured by Hodogaya Chemical Co., Ltd.) and BONTRON (registered trade mark) S-34, S-44, E-84, E-88 (manufactured by Orient Chemical Industries Co., Ltd.).

Furthermore, a charge control resin such as a copolymer between a vinyl monomer and a 2-acrylicamide-2-methylpropane sulfonate can be used, and can be used in combination with a charge-controlling agent as mentioned above.

In the magnetic toner of the present invention, as an fine inorganic powder capable of improving flowability of magnetic toner particles by attaching the fine inorganic powder on the surface of the magnetic toner particles, a silica fine particle having a BET specific surface area of 50 $m^2$/g or more but 300 $m^2$/g or less can be used. As the fine silica particle, any fine silica particle can be used as long as the fine silica particle can increase flowability by externally adding to a magnetic toner particle. Examples thereof include fine silica powder such as silica produced by a wet-process and silica produced by a dry-process and a surface-treated fine silica particle such as silica as mentioned above treated with a silane coupling agent, a titanium coupling agent or silicone oil.

Favorable fine silica particle include a fine silica particle produced by vapor-phase oxidation of a silicon halide compound and called dry-process silica or hummed silica.

Examples thereof include a fine silica particle produced by using a thermal decomposition oxidation reaction of silicon tetrachloride gas in oxygen or hydrogen. The reaction equation is as follows:

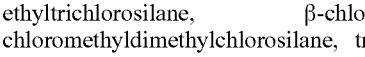

$$SiCl_4+2H_2+O_2 \rightarrow SiO_2+4HCl$$

A fine silica particle is hydrophobized by a method of chemically treating a fine silica particle with an organic silicon compound capable of reacting with a fine silica particle or physically adsorbing to a fine silica particle. As a favorable method, a fine silica particle produced by vapor-phase oxidation of a silicon halide compound is treated with an organic silicon compound. Examples of such an organic silicon compound include the following ones: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, 1-hexamethyl disiloxane, 1,3-divinyltetramethyldisiloxane, 1,3-diphenyltetramethyldisiloxane and dimethylpolysiloxane having 2 to 12 siloxane units per molecule and a hydroxy group bound to a single Si at the unit positioned at each of the ends. These may be used alone or as a mixture of two types or more.

The fine silica particle may be treated with silicone oil and may be treated with silicone oil in combination with the aforementioned hydrophobic treatment.

As a favorable silicone oil, a silicone oil having a viscosity of 30 $mm^2/s$ or more but 1000 $mm^2/s$ or less at 25° C. is used. Particularly favorable examples thereof include dimethylsilicone oil, methylphenylsilicone oil, α-methylstyrene modified silicone oil, chlorophenylsilicone oil and fluorine modified silicone oil.

Examples of a method for treating the fine silica particle with silicone oil include the following methods: a method of directly mixing a fine silica particle treated with a silane coupling agent with silicone oil by a mixer such as a Henschel mixer; a method of spraying silicone oil to a fine silica particle serving as a base; and a method of dissolving or dispersing silicone oil in an appropriate solvent, adding and mixing a fine silica particle to the solution and then removing the solvent from the solution. Silica fine particle treated with silicone oil is more favorably heated in an inactive gas up to a temperature of 200° C. or more (more favorably 250° C. or more) to stabilize coating on the surface of the silica fine particle.

As a favorable silane coupling agent, hexamethyldisilazane (HMDS) is mentioned.

The fine silica particle to be added for imparting flowability can be used in an amount of 0.1 part by mass or more and 8.0 parts by mass or less, and favorably 0.3 parts by mass or more but 4.0 parts by mass or less based on the magnetic toner particle (100.0 parts by mass).

The magnetic toner of the present invention favorably has, other than a fine silica particle for imparting flowability as mentioned above, fine inorganic powder C for controlling a dielectric loss factor at 40° C., having a volume resistivity of $5.0\times10^7$ Ω·cm or more but $1.0\times10^{14}$ Ω·cm or less. Examples of fine inorganic powder C that can be used include a metal oxide such as titanium oxide, aluminum oxide, indium oxide, magnesium oxide and barium oxide and an oxide complex of these. Of them, aluminum oxide and titanium oxide are particularly favorable.

For hydrophobing fine inorganic powder C, e.g., a silane coupling agent and a titanium coupling agent as shown below can be used.

Examples of the silane coupling agent include hexamethyldisilazane, methyltrimethoxysilane, octyltrimethoxysilane, and isobutyltrimethoxysilane. Favorably, octyltrimethoxysilane and isobutyltrimethoxysilane are used.

Examples of the titanium coupling agent include bis(dioctylpyrophosphate)oxyacetate titanate, bis(dioctylpyrophosphate)ethylene titanate, tetrabutyl titanate and tetraoctyl titanate.

Fine inorganic powder C may be favorably used in an amount of 0.1 part by mass or more but 4.0 parts by mass or less, and favorably in an amount of 0.1 part by mass or more but 3.0 parts by mass or less based on the magnetic toner particle (100.0 parts by mass).

The magnetic toner of the present invention is prepared by sufficiently mixing e.g., a binder resin, a colorant and other additives by a mixer such as a Henschel mixer or a ball mill, subjecting the mixture to melt/kneading performed by use of a heat-kneader such as a heat roll, a kneader and an extruder, cooling the mixture to solidify, pulverizing, classifying, and further adding a desired additive, if necessary, and sufficiently mixing the mixture by a mixer such as a Henschel mixer. In this manner, the magnetic toner of the present invention can be obtained.

Methods for measuring physical properties of the magnetic toner of the present invention are as shown below. The physical properties in Examples (described later) are measured based on these methods.

<Heat Flow Difference in Magnetic Toner, Endothermic Peak and Endothermic Quantity of Binder Resin>

In the present invention, Heat Flow difference of a magnetic toner, and the endothermic peak and endothermic quantity of a binder resin in a DSC curve are measured by the following methods. These are measured in accordance with ASTM D3418-82 using a differential scanning calory analyzer "Q1000" (manufactured by TA Instruments).

The temperature measured by a detecting section of the analyzer is corrected based on the melting points of indium and zinc and calory is corrected based on heat of fusion of indium.

To describe more specifically, a binder resin (about 5 mg) is weighed and placed in a pan made of aluminum. A vacant aluminum pan is used as a reference. Measurement is performed in the temperature range of 30 to 200° C. at a temperature raising rate of 10° C./min. Note that, in the measurement, temperature is increased once up to 200° C., subsequently decreased to 30° C. at a temperature decreasing rate of 10° C./min, and thereafter increased again. In this temperature raising process, a specific heat changes. The intersection between the DSC curve and the line drawn through the middle point of the base lines which are respectively drawn through the points before and after the point of specific heat change, is defined as a glass transition temperature Tg of the magnetic toner or the binder resin. Furthermore, the Heat Flow difference between 40° C. and 60° C. can be obtained from the measurement results.

In the second temperature raising process within the temperature range of 30° C. and 200° C., the endothermic peak obtained immediately after glass transition temperature Tg is defined as the endothermic peak P1 and the endothermic peak obtained by further raising the temperature is defined as the endothermic peak P2. On the other hand, the endothermic quantity ΔH of each of these endothermic peaks can be obtained by obtaining the value of integral of a region (peak region) surrounded by a base line and a DSC curve.

<Measurement of a Softening Point Tm of Binder Resin and Magnetic Toner>

The softening point of each of a binder resin and a magnetic toner is measured by use of a constant-load extruding type Capillary Rheometer "rheological property evaluation apparatus, Flow Tester CFT-500D" (manufactured by Shimadzu Corporation) in accordance with the manual attached to the apparatus. In the apparatus, the temperature of the measurement sample loaded in a cylinder is increased while applying a constant load by a piston onto a measurement sample to melt the sample. The measurement sample melted is extruded from a die at the bottom of the cylinder. The amount of descent of the piston at this time and temperature are plotted to obtain a rheogram showing the relationship of the amount of descent and the temperature.

In the present invention, "meting temperature in the ½ method" described in the manual attached to "rheological property evaluation apparatus, Flow Tester CFT-500D" is defined as a softening point. Note that the "meting temperature in the ½ method" is calculated as follows. First, the difference between Smax, which is the amount of descent of a piston at the time outflow is completed, and Smin, which is the amount of descent of a piston at the time outflow is initiated, is divided in half (this is expressed by X. X=(Smax−Smin)/2). Then, in the rheogram, the temperature at the time when the amount of descent of a piston is equal to a sum of X and 5 min is obtained. The temperature of the rheogram is the melting temperature Tm obtained by the ½ method.

A measurement sample is prepared by compress-molding a binder resin (about 1.0 g) under an environment of 25° C. by using a tablet forming compressor (for example, NT-100H, manufactured by NPa SYSTEM CO., LTD.) at a pressure of about 10 MPa for about 60 seconds into a disk having a diameter of about 8 mm.

The measurement conditions for CFT-500D are as follows.

Test mode: Temperature raising method
Initiation temperature: 50° C.
Achieving temperature: 200° C.
Measurement interval: 1.0° C.
Rate of temperature increase: 4.0° C./min
Sectional area of piston: 1.000 $cm^2$
Test load (piston load): 10.0 kgf (0.9807 MPa)
Preheating time: 300 seconds
Hole diameter of die: 1.0 mm
Length of die: 1.0 mm <Measurement of THF Insoluble Matter of Binder Resin and Magnetic Toner>

A resin and magnetic toner (about 1.0 g) each are weighed (W1 g) and placed in a cylindrical filter (for example, No. 86R, size 28×100 mm manufactured by Advantec Toyo Kaishia, Ltd.) and subjected to a Soxhlet extractor and extracted for 16 hours using THF (200 ml) as a solvent.

The extraction is repeatedly performed at a rate of once in about 4 minutes.

After completion of the extraction, the cylindrical filter is taken out and dried at 40° C. for 8 hours in vacuum and extraction residue is weighed (W2 g).

In the case of a magnetic toner, the weight of incineration residue (ash content) of the magnetic toner (W3 g) is obtained by the following procedure.

In a magnetic crucible (30 ml) previously weighed, about 2 g of a sample is placed and weighed to obtain mass (Wa g). The crucible is placed in an electric furnace, heated at about 900° C. for about 3 hours, and gradually cooled in the electric furnace and cooled at normal temperature in a desiccator for one hour or more and then the mass of the crucible is weighed. From this, the weight of incineration residue (ash content) (Wb g) is obtained.

$$(Wb/Wa)\times 100=\text{incineration residue(ash content)content(mass\%)}$$

From the content, the mass of the incineration residue (ash content) (W3 g) of a sample can be obtained.

THF insoluble matter of a magnetic toner can be obtained by the following formula.

$$\text{THF insoluble matter of magnetic toner(\%)}=[W2-W3]/[W1-W3]\times 100$$

Furthermore, the THF insoluble matter of a binder resin can be obtained by the following equation.

$$\text{THF insoluble matter(\%)}=W2/W1\times 100$$

Note that when a resin having a high crystallinity is measured, part of a crystal component is sometimes calculated as a THF insoluble matter.

<Measurement of Molecular Weight Distribution by GPC>

A column was stabilized in a heat chamber of 40° C. To the column stabilized at this temperature, THF as a solvent is supplied at a rate of 1 ml per minute. Like this, a THF sample solution (about 100 μl) is supplied and subjected to measurement. In measurement of the molecular weight of a sample, the molecular weight distribution of the sample is calculated based on the relationship between a logarithmic value and count value of a calibration curve prepared from several mono-dispersed polystyrene reference samples. As the standard polystyrene sample for preparing a calibration curve, for example, a standard polystyrene sample having a molecular weight of about $10^2$ to $10^7$ manufactured by Tohso Corporation or Showadenkosha. co., ltd. is used. It is proper to use at least about 10 standard polystyrene samples. Furthermore, as a detector, an RI (refractive index) detector is used. Note that, as a column, commercially available polystyrene gel columns are favorably used in combination. Examples of the column include a combination of Shodex GPC KF-801, 802, 803, 804, 805, 806, 807, 800P (manufactured by Showadenkosha. co., ltd.) and a combination of TSKgel G1000H ($H_{XL}$), G2000H ($H_{XL}$), G3000H ($H_{XL}$), G4000H ($H_{XL}$) G5000H ($H_{XL}$), G6000H ($H_{XL}$), G7000H ($H_{XL}$) and TSKgurd column (manufactured by Tohso Corporation).

Furthermore, GPC samples are prepared as follows.

A sample is placed in THF, allowed to stand still at 25° C. for several hours and sufficiently shaken to mix well with THF (until sample agglomeration disappears) and allowed to stand still further for 12 hours or more such that the sample is allowed to stand still in total for 24 hours. Thereafter, the mixture is allowed to pass through a sample treatment filter (pore size: 0.2 μm or more and 0.5 μm or less, for example, Myshori disk H-25-2 (manufactured by Tohso Corporation) can be used). The resultant material is used as a GPC sample. Furthermore, a sample concentration is adjusted such that a resin component is contained in an amount of 0.5 mg/ml or more and 5.0 mg/ml or less.

<Measurement of Magnetic Properties of Magnetic Iron Oxide>

Magnetic properties of a magnetic iron oxide are measured by use of a vibrating sample magnetometer VSM-P7 manufactured by TOEI INDUSTRY CO., LTD. and keeping a sample at a temperature of 25° C. and at an external magnetic field of 795.8 kA/m.

<Determination of Shape and Average Primary Particle Size Of Magnetic Iron Oxide>

An average primary particle size is obtained as a number average particle diameter by measuring Feret's diameters of 200 magnetic iron oxide particles under observation of a scanning electron microscope (magnification: 40000 fold) and averaged. Furthermore, the shape of a magnetic iron oxide particle is determined by observing the image. The scanning electron microscope used in Examples was S-4700 (manufactured by Hitachi, Ltd.).

<Measurement of Volume Resistivity of Magnetic Iron Oxide>

Magnetic iron oxide (10 g) was placed in a measurement cell and molded by a hydraulic cylinder (pressure: 600 kg/cm$^2$). After the pressure is released, a resistance meter (YEW MODEL 2506A DIGITAL MALTIMETER manufactured by Yokogawa Electric Corporation) is set and again pressure (150 kg/cm$^2$) is applied by the hydraulic cylinder. Measurement is started in this manner and a measurement value in three minutes is read out.

Furthermore, the thickness of a sample is measured and the volume resistivity thereof is obtained in accordance with the following equation.

Volume resistivity(Ω·cm)=(resistance measurement value(Ω)×sectional area of sample(cm$^2$))/sample thickness(cm)

<Measurement of Volume Resistivity of Fine Inorganic Powder C>

Volume resistivity of fine inorganic powder C is measured by cell a illustrated in FIGURE as follows.

Cell a is charged with fine inorganic powder C and electrodes 1 and 2 are arranged so as to be in contact with the fine inorganic powder C represented by reference numeral 7. Voltage is applied between the electrodes from a constant voltage apparatus 6. The voltage applied to the cell at this time is obtained by monitoring the voltage by a voltmeter 5 and the current supplied at this time is measured by an electric current meter 4. Note that reference numeral 3 represents an insulating material and reference numeral 8 represents a guide ring.

The measurement conditions thereof are: an environment of 23° C., and humidity of 65%, each of the contact areas of fine inorganic powder C with electrodes 1 and 2: S=0.283 cm$^2$, a thickness of fine inorganic powder C: d=1.0 mm, load applied on the upper electrode 2: 11.8 kPa (120 g/cm$^2$), an application voltage: 400 V.

<Measurement Method for Weight Average Particle Size (D4)>

The weight average particle size (D4) of a magnetic toner is determined by using a precision grain size distribution measurement apparatus called "Coulter counter Multisizer 3" (registered trade mark, manufactured by Beckman Coulter) equipped with a 100 μm-aperture tube based on pore electrical resistance method and using special software "Beckman Coulter Multisizer 3 Version 3.51" (manufactured by Beckman Coulter) attached to the equipment for setting measurement conditions and analyzing measurement data, with an effective number of measurement channels of 25,000. The measurement data is analyzed and computationally obtained.

The aqueous electrolyte solution to be used in measurement is prepared by dissolving a special-grade sodium chloride in ion exchange water so as to obtain a concentration of about 1 mass %. For example, "ISOTON II" (manufactured by Beckman Coulter) can be used.

Note that before measurement and analysis are performed, the special software is set up as follows.

In the "setting screen for changing standard operation method (SOM)" of the special software, the total count number of a control mode is set at 50000 particles and measurement times is set at 1. As the Kd value, the value obtained by using "a standard particle 10.0 μm" (manufactured by Beckman Coulter) is set. A threshold/noise level measurement button is pressed to automatically set a threshold and noise levels. Furthermore, current is set at 1600 μA and gain is set at 2. An electrolyte is set at ISOTON II and flush of the aperture tube after measurement is checked.

In the "setting screen for converting pulse to particle diameter" of the special software, the interval between bins is changed to logarithmic particle diameter; the particle diameter bin is set at 256 particle diameter bin; and the particle diameter range is set at 2 μm to 60 μm.

Specific measurement method is as follows.

(1) To a 250-ml round-bottom beaker made of glass for exclusive use for Multisizer 3, an aqueous electrolyte solution (about 200 ml) as mentioned above is supplied. The beaker is placed in a sample stand. The aqueous electrolyte solution was stirred by rotating a stirrer rod counterclockwise at 24 rotations/second. Subsequently, using "flush aperture" function of the analysis soft, contaminants and air bubbles within an aperture tube are previously removed.

(2) To a 100 ml flat-bottom beaker made of glass, the aqueous electrolyte solution (about 30 ml) is supplied. To the aqueous electrolyte solution, about 0.3 ml of a dilution solution, which is prepared by diluting "Contaminon N" (an aqueous 10 mass % solution of a neutral detergent for cleaning precision measuring equipment containing a nonionic surfactant, an anion surfactant, an organic builder, pH7; manufactured by Wako Pure Chemical Industries Ltd.) serving as a dispersant, with ion exchange water three fold by mass, is added.

(3) In the water vessel of "Ultrasonic Dispersion System Tetora 150" (manufactured by Nikkaki Bios Co., Ltd) housing two oscillators having an oscillation frequency of kHz with the phases shifted by 180° and having an electric output of 120 W, a predetermined amount of ion exchange water is supplied, and Contaminon N (about 2 ml) as mentioned above is added to the ion exchange water in the water vessel.

(4) The beaker (2) is set at a beaker fixing hole of the ultrasonic dispersion system and the ultrasonic dispersion system is driven. Subsequently, the level of the beaker is controlled such that the resonant condition of liquid surface of the aqueous electrolyte solution in the beaker reaches a maximum.

(5) While applying ultrasonic wave to the aqueous electrolyte solution in the beaker (4), a magnetic toner (about 10 mg) is added to the aqueous electrolyte solution little by little and dispersed. Then, the dispersion treatment with ultrasonic wave is continued for further 60 seconds. Note that, in the dispersion treatment with ultrasonic wave, the temperature of water in the water vessel is appropriately controlled so as to fall within the range of 10° C. or more and 40° C. or less.

(6) To the round-bottom beaker (1) set at the sample stand, the above aqueous electrolyte solution (5) having a magnetic toner dispersed therein is added dropwise by a pipette. The measurement concentration is controlled so as to be about 5%. Then, measurement is performed until a number of particles reaches 50000.

(7) Measurement data is analyzed by the special software attached to the apparatus to computationally obtain a weight average particle size (D4). Note that "average diameter" of an analysis/volume statistical value (arithmetic average) screen when graph/vol. % is set in the special software is the weight average particle size (D4).

EXAMPLES

In the foregoing, the basic constitution and characteristics of the present invention have been described. Now, the present invention will be described in detail based on Examples, below. However, the embodiments of the present invention are not limited by Examples.

<Production Example of Binder Resin A-1>

| | |
|---|---|
| Terephthalic acid | 100 parts by mol |
| Ethylene glycol | 60 parts by mol |
| Neopentyl glycol | 40 parts by mol |

The above polyester monomers were supplied together with an esterification catalyst (dibutyl tin oxide) into a 5-liter autoclave. To the autoclave, a reflux condenser, a water separation apparatus, a $N_2$ gas inlet pipe, a thermometer and a stirrer were provided. While a $N_2$ gas was introduced into the autoclave, a polycondensation reaction was performed at 230° C. While monitoring the rate of progression of the reaction based on viscosity, trimellitic anhydride (5 parts by mol) was added when the reaction entered the later half period. After completion of the reaction, the reaction product was taken out from a container, cooled and pulverized to obtain binder resin A-1. The physical properties of the resin are shown in Table 1.

<Production Examples of Binder Resins A-2 to A-7>

Binder resins A-2 to A-7 were prepared in the same manner as in obtaining binder resin A-1 except that monomers shown in Table 1 were used and the reaction time was adjusted so as to obtain the softening points shown in Table 1. Physical properties of these resins are shown in Table 1.

<Production Example of Binder Resin A-8>

| | |
|---|---|
| Terephthalic acid | 32 parts by mol |
| Trimellitic acid | 8 parts by mol |
| Propoxylated bisphenol A (2.2 mol adduct) | 34 parts by mol |
| Ethoxylated bisphenol A (2.2 mol adduct) | 26 parts by mol |

The above polyester monomers were supplied together with an esterification catalyst into a 4-neck flask. To the flask, a pressure reducing apparatus, a water separation apparatus, a nitrogen gas introducing apparatus, a temperature measurement apparatus and a stirrer were provided. The mixture was stirred under a nitrogen atmosphere at 135° C.

To the mixture, a mixture including of a vinyl monomer containing a polyester monomer and a vinyl monomer in a mass ratio of 8:2 (styrene: 83 parts by mol and 2 ethylhexyl acrylate: 15 parts by mol) and benzoyl peroxide (2 parts by mol) serving as a polymerization initiator was added dropwise through a dropping funnel over 4 hours.

Thereafter, the reaction was performed at 135° C. for 5 hours, and the condensation polymerization reaction was performed by raising the reaction temperature to 230° C. After completion of the reaction, a reaction product was taken out from the container, cooled, and pulverized to obtain binder resin A-8. The physical properties of the resin are shown in Table 1.

<Production Examples of Binder Resins A-9 to A-11>

Binder resins A-9 to A-11 were prepared in the same manner as in obtaining binder resin A-1 except that monomers shown in Table 1 were used and the reaction time was adjusted so as to obtain the softening points shown in Table 1. Physical properties of these resins are shown in Table 1.

<Production Example of Binder Resin B-1>

In a 2 L-four neck flask equipped with a nitrogen introducing pipe, a dewatering pipe, a stirrer and a thermocouple, binder resin A-1 (90.0 parts by mass) and a binder resin A-9 (10.0 parts by mass) were mixed. To the mixture solution, benzoyl peroxide (0.1 part by mass) was added and the reaction was performed at 80° C. while controlling the reaction time such that THF insoluble matter reached 22.0 mass % to obtain binder resin B-1. The physical properties of the resin are shown in Table 3.

<Production Examples of Binder Resins B-2, B-3, B-5 and B-7>

Binder resins B-2, B-3, B-5 and B-7 were prepared in the same manner as in obtaining binder resin B-1 except that a binder resin was changed as shown in Table 2 and the reaction time was controlled such that THF insoluble matter was contained in a desired amount. Physical properties of these resins are shown in Table 3.

<Production Example of Binder Resin B-4>

As shown in Table 2, binder resin A-4 (90.0 parts by mass) and binder resin A-8 (10.0 parts by mass) were mixed in a Henschel mixer to obtain binder resin B-4. Physical properties of the resin are shown in Table 3.

<Production Example of Binder Resins B-6, B-8 and B-9>

As shown in Table 2, A-6, A-7 and A-8 were used respectively for obtaining binder resins B-6, B-8 and B-9. Physical properties of these resins are shown in Table 3.

<Production Example of Binder Resin B-10>

Binder resin A-4 (90.0 parts by mass) and binder resin A-11 (10.0 parts by mass) and benzoyl peroxide (0.1 part by mass) were added, mixed and supplied to a twin screw extruder (manufactured by IKEGAI Metal, PCM-29: L/D=30). A crosslinking reaction was performed at an external temperature set at 180° C. to obtain binder resin B-10. Physical properties of the resin are shown in Table 3.

Example 1

| | |
|---|---|
| Binder resin B-1 | 100.0 parts by mass |
| Magnetic iron oxide-1 | 45.0 parts by mass |
| Commercially available low-molecular weight polypropylene wax (Biscol 660-P) | 4.0 parts by mass |
| Charge-controlling agent-1 (the following formula) | 2.0 parts by mass |

(3)

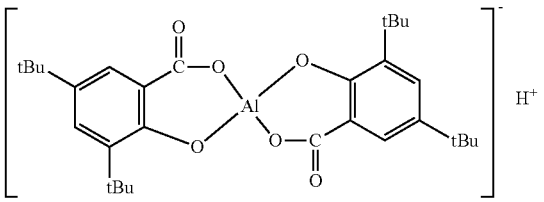

The above materials were previously mixed by a Henschel mixer and then melted and kneaded by a twin-screw kneading extruder. The kneaded product obtained was cooled, roughly pulverized by a hammer mill and then pulverized by a jet mill. The resultant pulverized fine powder was classified by use of a hyper fractionation classifier using the Coanda effect to obtain a magnetic toner particle negatively charged and having a weight average particle size (D4) of 7.0 μm.

To a magnetic toner particle (100.0 parts by mass), a hydrophobic fine silica particle (1.0 part by mass) [BET specific surface area: 300 $m^2/g$, hydrophobically treated with hexamethyldisilazane (HMDS)] and fine inorganic powder C-1 (0.2 parts by mass) were externally added and mixed. Thereafter, the mixture was sieved by a mesh having an opening of 150 μm to obtain magnetic toner 1. Composition and obtained physical properties of the magnetic toner are shown in Table 6.

Magnetic toner 1 was evaluated by the following method. The evaluation results are shown in Table 7.

(1) Electrostatic Offset Evaluation

A commercially available printer (Laser Jet P4515n, manufactured by HP) was modified into a fixing apparatus by adjusting a process speed at 450 mm/sec and such that an electric field cannot be forcibly generated.

Using this, an image was continuously printed on 500 sheets by use of a chart for an electrostatic offset test in which 15 lines of 0.2 mm in width at intervals of 1 cm were drawn in perpendicular to the feeding direction of a transfer material in the front half of an image and a white portion was present in the later half. The white portion of the image was evaluated for electrostatic offset property under observation of an optical microscope (magnification: 30 fold).

Note that test was performed in a low-temperature and low humidity environment (15° C., 5% RH) and a dry paper (moisture content: less than 4%) was used as a transfer material.

A: No scattering is observed.

B: Scattering is more or less observed in a single paper when magnified by an optical microscope.

C: Scattering is more or less observed in 2 to 4 (both inclusive) paper sheets when magnified by an optical microscope.

D: Scattering is more or less observed in 5 to 10 (both inclusive) paper sheets when magnified by an optical microscope.

E: Scattering is more or less observed in not less than 11 paper sheets when magnified by an optical microscope.

(2) Evaluation of Adhesiveness to a Transfer Material

A commercially available LBP printer (Laser Jet P4515n, manufactured by HP) was modified into a fixing apparatus by adjusting a process speed at 450 mm/sec and such that an electric field cannot be forcibly generated.

Using this, a solid image was printed on 500 sheets under a low-temperature and low humidity (15° C., 5% RH) environment such that the application amount of magnetic toner on a transfer material was 0.45 mg/cm$^2$ or more and 0.50 mg/cm$^2$ or less. Thereafter, 500 images obtained were visually observed and evaluated in accordance with the following criteria.

A: No white-spot image omission was observed on a solid black image.

B: White-spot image omission was observed on a solid black image in only one of 500 sheets.

C: White-spot image omission was observed on a solid black image in 2 to 5 (both inclusive) of 500 sheets.

D: White-spot image omission was observed on a solid black image in 6 to 10 (both inclusive) of 500 sheets.

E: White-spot image omission was observed on a solid black image in not less than 11 of 500 sheets.

(3) Evaluation of Scattering

Using the modified printer mentioned above, an image in which 24 lines of 0.2 mm in width were drawn at intervals of 1 cm in perpendicular to the feeding direction of a transfer material was continuously printed out on 5000 sheets under a low-temperature and low humidity (15° C., 5% RH) environment. In every 500 sheets, a copy containing 8 point-size letter "a" was printed out and scattering of a magnetic toner on the copy was observed by an optical microscope (magnification: 30 fold) for a total number of sheets and evaluated in accordance with the following criteria.

A: The total number of magnetic toner scattering dots around an image is less than 10.

B: The total number of magnetic toner scattering dots around an image is 10 or more and less than 20.

C: The total number of magnetic toner scattering dots around an image is 20 or more and less than 30.

D: The total number of magnetic toner scattering dots around an image is 30 or more.

(4) Evaluation of Letter Collapse

Using the modified printer mentioned above, an image in which 24 lines of 0.2 mm in width were drawn at intervals of 1 cm in perpendicular to the feeding direction of a transfer material was continuously printed out on 5000 sheets under a low-temperature and low humidity (15° C., 5% RH) environment. In every 500 sheets, an image of 5 point-size letter drawn in the entire paper (Chinese character "電驚" in the present invention) was output, and a degree of collapse of the Chinese character of a magnetic toner was evaluated by use of an optical microscope (magnification: 30 fold) for a total number of 10 sheets in accordance with the following criteria.

A: No collapse of letters is observed even under observation by an optical microscope.

B: Collapse of 1 to 5 (both inclusive) letters is observed.

C: Collapse of 6 to 10 (both inclusive) letters is observed.

D: Collapse of 11 to 20 (both inclusive) letters is observed.

E: Collapse of 21 or more letters is observed.

With respect to Example 1, good results were obtained in any one of evaluations.

Examples 2 to 15

Magnetic toners 2 to 15 were prepared in the same manner as in Example 1 except that compositions of the binder resin, magnetic iron oxide, charge-controlling agent and fine inorganic powder C were set as shown in Table 6. Physical properties of magnetic iron oxides are shown in Table 4; physical properties of fine inorganic powders C are shown in Table 5; and the physical properties of magnetic toners are shown in Table 6. In Table 6, "T77" represents a charge-controlling agent "T-77" manufactured by Hodogaya Chemical Co., LTD. Furthermore, the evaluation results are similarly shown in Table 7.

Comparative Examples 1 to 5

Magnetic toners 16 to 20 were prepared in the same manner as in Example 1 except that compositions of the binder resin, magnetic iron oxide, charge-controlling agent and fine inorganic powder C were set as shown in Table 6. Physical properties of magnetic iron oxides are shown in Table 4; physical properties of fine inorganic powders C are shown in Table 5; and the physical properties of magnetic toners are shown in Table 6. Furthermore, the evaluation results are similarly shown in Table 7.

TABLE 1

| Resin No. | Monomer constitution (mol %) | | | | | Peak temperature (° C.) | Main ΔH (J/g) | Tm (° C.) | Mp (R) | Mw (R) | THF insoluble matter (mass %) |
|---|---|---|---|---|---|---|---|---|---|---|---|
| A-1 | TPA (100) | EG (60) | NPG (40) | TMA (5) later added | — | 64 | 0.32 | 90 | 7900 | 9100 | 0.0 |
| A-2 | TPA (100) | EG (60) | NPG (40) | TMA (5) later added | — | 73 | 0.30 | 93 | 9800 | 11000 | 0.0 |
| A-3 | TPA (100) | EG (65) | 1,3-propanediol (5) | NPG (30) | — | 68 | 0.35 | 95 | 12000 | 15000 | 0.0 |
| A-4 | TPA (85) | FA (15) | BPA-EO (40) | BPA-PO (60) | — | 56 | 0.24 | 95 | 7000 | 8500 | 0.0 |
| A-5 | TPA (90) | FA (10) | EG (70) | 1,3-propanediol (5) | NPG (25) | 64 | 0.38 | 100 | 10000 | 13500 | 0.0 |
| A-6 | TPA (84) | TMA (16) | EG (30) | NPG (70) | — | 75 | 0.12 | 146 | 6000 | 16000 | 31.0 |
| A-7 | TPA (94) | TMA (6) | BPA-PO (100) | — | — | — | — | 120 | 9000 | 18000 | 20.0 |
| A-8 | Hybrid resin | | | | | — | — | 135 | 7000 | 150000 | 20.0 |
| A-9 | TPA (80) | FA (19) | TMA (1) | 1,4-CHDM (60) | EG (40) | 64 | 0.24 | 140 | 18000 | 38000 | 0.0 |
| A-10 | TPA (80) | FA (15) | TMA (5) | BPA-EO (70) | BPA-PO (30) | 77 | 0.10 | 108 | 15000 | 35000 | 0.0 |
| A-11 | TPA (80) | FA (18) | TMA (2) | 1,4-CHDM (60) | EG (40) | 71 | 0.16 | 160 | 27000 | 46000 | 0.0 |

TPA Terephthalic acid
TMA Trimellitic anhydride
FA Fumaric acid
BPA-PO Bisphenol A propylene oxide adduct
BPA-EO Bisphenol A ethylene oxide adduct
NPG Neopentyl glycol
EG 1,4-cyclohexane dimethanol

TABLE 2

| Resin No. | Resin A | | | |
|---|---|---|---|---|
| | Type | Addition amount (parts by mass) | Type | Addition amount (parts by mass) |
| B-1 | A-1 | 90.0 | A-9 | 10.0 |
| B-2 | A-2 | 90.0 | A-9 | 10.0 |
| B-3 | A-3 | 90.0 | A-9 | 10.0 |
| B-4 | A-4 | 90.0 | A-8 | 10.0 |
| B-5 | A-5 | 90.0 | A-9 | 10.0 |
| B-6 | A-6 | 100.0 | — | — |
| B-7 | A-4 | 90.0 | A-10 | 10.0 |
| B-8 | A-7 | 100.0 | — | — |
| B-9 | A-8 | 100.0 | — | — |
| B-10 | A-4 | 90.0 | A-11 | 10.0 |

TABLE 3

| Resin No. | Peak temperature (° C.) | Main ΔH (J/g) | Tm (° C.) | Mp (R) | Mw (R) | THF insoluble matter (mass %) |
|---|---|---|---|---|---|---|
| B-1 | 64 | 0.30 | 130 | 8100 | 9300 | 22 |
| B-2 | 72 | 0.29 | 134 | 10000 | 14000 | 22 |
| B-3 | 65 | 0.32 | 135 | 13000 | 16000 | 22 |
| B-4 | 60 | 0.20 | 120 | 7200 | 900000 | 5 |
| B-5 | 64 | 0.34 | 130 | 9000 | 10000 | 17 |
| B-6 | 75 | 0.11 | 146 | 6500 | 17500 | 31 |
| B-7 | 66 | 0.16 | 161 | 9000 | 32000 | 40 |
| B-8 | — | — | 120 | 9000 | 18000 | 20 |
| B-9 | — | — | 135 | 7000 | 150000 | 20 |
| B-10 | 66 | 0.10 | 121 | 12000 | 16000 | 15 |

TABLE 4

| | Shape | Average particle diameter (μm) | Volume resistivity value (Ω · cm) | Hc (kA/m) | σs ($Am^2/kg$) | σr ($Am^2/kg$) |
|---|---|---|---|---|---|---|
| Magnetic iron oxide-1 | Octahedron | 0.15 | $5.0 \times 10^4$ | 11.8 | 87.8 | 12.2 |
| Magnetic iron oxide-2 | Octahedron | 0.15 | $6.0 \times 10^6$ | 11.2 | 86.5 | 11.8 |
| Magnetic iron oxide-3 | Octahedron | 0.15 | $3.0 \times 10^3$ | 12.2 | 88.2 | 12.8 |
| Magnetic iron oxide-4 | Polyhedron | 0.15 | $2.0 \times 10^6$ | 7.8 | 87.1 | 7.1 |

TABLE 5

| | Main phase | Treatment agent | Volume resistivity value (Ω · cm) |
|---|---|---|---|
| Fine inorganic powder C-1 | $TiO_2$ | Octyltrimethoxysilane | $6.0 \times 10^{13}$ |
| Fine inorganic powder C-2 | $TiO_2$ | Isobutyltrimethoxysilane | $4.0 \times 10^{11}$ |
| Fine inorganic powder C-3 | $Al_2O_3$ | None | $5.7 \times 10^{13}$ |
| Fine inorganic powder C-4 | $TiO_2$ | None | $4.0 \times 10^{4}$ |

TABLE 6

| | | Binder resin | | Magnetic iron oxide | | Charge-controlling agent | | Fine inorganic powder C | |
|---|---|---|---|---|---|---|---|---|---|
| | Toner No. | No. | Addition amount (parts by mass) | No. | Addition amount (parts by mass) | No. | Addition amount (parts by mass) | No. | Addition amount (parts by mass) |
| Example 1 | 1 | B-1 | 100.0 | 1 | 45.0 | 1 | 2.0 | C-1 | 0.2 |
| Example 2 | 2 | B-1 | 100.0 | 1 | 30.0 | 1 | 2.0 | C-1 | 0.2 |
| Example 3 | 3 | B-1 | 100.0 | 1 | 80.0 | 1 | 2.0 | C-1 | 0.2 |
| Example 4 | 4 | B-2 | 100.0 | 1 | 45.0 | 1 | 2.0 | C-1 | 0.2 |
| Example 5 | 5 | B-3 | 100.0 | 1 | 45.0 | 1 | 2.0 | C-1 | 0.2 |
| Example 6 | 6 | B-2 | 100.0 | 1 | 25.0 | 1 | 2.0 | C-1 | 0.2 |
| Example 7 | 7 | B-3 | 100.0 | 1 | 95.0 | 1 | 2.0 | C-1 | 0.2 |
| Example 8 | 8 | B-5 | 100.0 | 2 | 95.0 | 1 | 2.0 | C-1 | 0.2 |
| Example 9 | 9 | B-4 | 100.0 | 3 | 25.0 | 1 | 2.0 | C-1 | 0.2 |
| Example 10 | 10 | B-1 | 100.0 | 1 | 45.0 | 1 | 2.0 | C-2 | 0.2 |
| Example 11 | 11 | B-1 | 100.0 | 1 | 45.0 | 1 | 2.0 | C-3 | 0.2 |
| Example 12 | 12 | B-2 | 100.0 | 1 | 45.0 | 1 | 2.0 | C-4 | 0.2 |
| Example 13 | 13 | B-3 | 100.0 | 1 | 95.0 | T77 | 2.0 | C-1 | 0.2 |
| Example 14 | 14 | B-4 | 100.0 | 3 | 25.0 | T77 | 2.0 | C-4 | 0.2 |
| Example 15 | 15 | B-6 | 100.0 | 4 | 30.0 | T77 | 2.0 | — | — |
| Comparative Example 1 | 16 | B-7 | 100.0 | 3 | 20.0 | 1 | 2.0 | C-2 | 0.2 |
| Comparative Example 2 | 17 | B-8 | 100.0 | 3 | 100.0 | T77 | 2.0 | — | — |
| Comparative Example 3 | 18 | B-9 | 100.0 | 3 | 80.0 | T77 | 2.0 | — | — |
| Comparative Example 4 | 19 | B-10 | 100.0 | — | 0.0 | T77 | 2.0 | — | — |
| Comparative Example 5 | 20 | B-8 | 100.0 | 3 | 90.0 | T77 | 2.0 | — | — |

| | Dielectric loss factor at 40° C. (pF/m) | Dielectric loss factor at 150° C. (pF/m) | Heat flow difference between 40° C. and 60° C. (W/g) | Tm (° C.) | Mp (° C.) | THF insoluble matter (mass %) |
|---|---|---|---|---|---|---|
| Example 1 | 0.50 | 1.00 | 0.050 | 131 | 8200 | 22.5 |
| Example 2 | 0.47 | 1.01 | 0.050 | 131 | 8200 | 22.5 |
| Example 3 | 0.58 | 0.99 | 0.050 | 131 | 8200 | 22.5 |
| Example 4 | 0.48 | 0.71 | 0.048 | 134 | 10500 | 22.5 |
| Example 5 | 0.56 | 1.91 | 0.052 | 136 | 13500 | 22.5 |
| Example 6 | 0.43 | 0.61 | 0.048 | 134 | 10500 | 22.5 |
| Example 7 | 0.75 | 2.40 | 0.052 | 136 | 13500 | 22.5 |
| Example 8 | 0.96 | 0.50 | 0.055 | 131 | 9200 | 17.5 |
| Example 9 | 0.42 | 3.20 | 0.039 | 122 | 7400 | 4.8 |
| Example 10 | 0.47 | 1.01 | 0.050 | 131 | 8200 | 22.5 |
| Example 11 | 0.50 | 1.00 | 0.050 | 131 | 8200 | 22.5 |
| Example 12 | 0.41 | 0.62 | 0.048 | 134 | 10500 | 22.5 |
| Example 13 | 0.79 | 2.60 | 0.052 | 136 | 13500 | 22.5 |
| Example 14 | 0.40 | 3.40 | 0.039 | 122 | 7400 | 17.5 |
| Example 15 | 0.40 | 3.80 | 0.035 | 145 | 6800 | 31.5 |
| Comparative Example 1 | 0.42 | 0.48 | 0.035 | 160 | 9200 | 40.5 |
| Comparative Example 2 | 0.40 | 4.30 | 0.032 | 121 | 9200 | 20.0 |

TABLE 6-continued

| | | | | | | |
|---|---|---|---|---|---|---|
| Comparative Example 3 | 0.26 | 0.51 | 0.032 | 136 | 7400 | 20.0 |
| Comparative Example 4 | 0.33 | 0.36 | 0.039 | 122 | 12600 | 15.5 |
| Comparative Example 5 | 0.36 | 4.20 | 0.032 | 120 | 9000 | 16.0 |

TABLE 7

| | Electrostatic offset | Adhesion property | Scattering | Letter-collapse evalution |
|---|---|---|---|---|
| Example 1 | A | A | A | A |
| Example 2 | A | A | A | A |
| Example 3 | A | A | A | A |
| Example 4 | A | A | A | A |
| Example 5 | A | A | A | A |
| Example 6 | B | A | A | B |
| Example 7 | A | B | B | A |
| Example 8 | A | A | C | C |
| Example 9 | C | C | A | A |
| Example 10 | A | A | A | A |
| Example 11 | A | A | A | A |
| Example 12 | C | A | A | B |
| Example 13 | A | C | B | B |
| Example 14 | C | C | A | B |
| Example 15 | C | C | B | B |
| Comparative Example 1 | D | B | C | D |
| Comparative Example 2 | D | E | D | B |
| Comparative Example 3 | E | B | D | C |
| Comparative Example 4 | E | B | D | E |
| Comparative Example 5 | E | D | D | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-015266, filed Jan. 27, 2011, which is hereby incorporated by reference herein in its entirety.

What is claimed is:

1. A magnetic toner comprising magnetic toner particles, each of which contains a binder resin and a magnetic material, and a fine inorganic powder, wherein the binder resin comprises a polyester unit, the magnetic toner has i) a dielectric loss factor at 40° C. and 100 kHz of 0.40 pF/m or more but 1.00 pF/m or less, and ii) a dielectric loss factor at 150° C. and 100 kHz of 0.50 pF/m or more but 4.00 pF/m or less.

2. The magnetic toner according to claim 1, wherein the magnetic toner particle comprises a salicylic metal compound.

3. The magnetic toner according to claim 1, wherein the fine inorganic powder comprises a fine silica particle and fine inorganic powder C, and the fine inorganic powder C has a volume resistivity of $5.0\times10^{7}$ Ω·cm or more but $1.0\times10^{14}$ Ω·cm or less.

* * * * *